US010581226B2

(12) United States Patent
Usami et al.

(10) Patent No.: US 10,581,226 B2
(45) Date of Patent: Mar. 3, 2020

(54) SPARK PLUG

(71) Applicant: NGK Spark Plug Co., LTD., Nagoya (JP)

(72) Inventors: Kohei Usami, Nagoya (JP); Yuichi Yamada, Niwa-gun (JP)

(73) Assignee: NGK Spark Plug Co., LTD., Nagoya (JP)

( * ) Notice: Subject to any disclaimer, the term of this patent is extended or adjusted under 35 U.S.C. 154(b) by 90 days.

(21) Appl. No.: 15/882,368

(22) Filed: Jan. 29, 2018

(65) Prior Publication Data

US 2018/0287349 A1 Oct. 4, 2018

(30) Foreign Application Priority Data

Mar. 31, 2017 (JP) ..... 2017-069843

(51) Int. Cl.

| | |
|---|---|
| ***H01T 13/20*** | (2006.01) |
| ***H01T 13/52*** | (2006.01) |
| ***H01T 13/50*** | (2006.01) |
| ***H05H 1/52*** | (2006.01) |
| *H01T 13/38* | (2006.01) |
| *H01T 19/04* | (2006.01) |

(52) U.S. Cl.

CPC ..... *H01T 13/20* (2013.01); *H01T 13/50* (2013.01); *H01T 13/52* (2013.01); *H05H 1/52* (2013.01); *H01T 13/38* (2013.01); *H01T 19/04* (2013.01)

(58) Field of Classification Search

CPC ..... H01T 13/20; H01T 13/50; H01T 13/52; H01T 13/32; H01T 13/34; H05H 1/52; F02P 15/00

See application file for complete search history.

(56) References Cited

U.S. PATENT DOCUMENTS 5,508,582 A 4/1996 Sugimoto et al.
5,565,157 A 10/1996 Sugimoto et al.
(Continued)

FOREIGN PATENT DOCUMENTS

EP 0622881 A 11/2011
EP 2724430 B 3/2015
(Continued)

OTHER PUBLICATIONS

Extended European Search Report dated Aug. 17, 2018 for the corresponding European Patent Application No. 18162849.6.

*Primary Examiner* — Syed O Hasan

(74) *Attorney, Agent, or Firm* — Leason Ellis LLP

(57) ABSTRACT

A spark plug includes: a center electrode; an insulator having a through hole around a part of the center electrode; and a metal shell holding the insulator from an outer peripheral side thereof. The metal shell includes a shelf portion that projects radially inward. The insulator includes an engagement portion engaged with the shelf portion from the front side, and a front end portion at the front side with respect to a front end of the metal shell. The front end portion has an outer diameter larger than an inner diameter of the metal shell at the front side with respect to the shelf portion. The front end portion of the insulator has a diameter-enlarged portion at which a diameter of the through hole increases and which is spaced apart from an outer peripheral surface of the center electrode.

5 Claims, 3 Drawing Sheets

(56) References Cited

U.S. PATENT DOCUMENTS

| | | | | |
|---|---|---|---|---|
| 8,550,048 | B2 * | 10/2013 | Stifel | H01T 13/467 123/143 B |
| 2008/0284303 | A1 | 11/2008 | Agneray et al. | |
| 2011/0221327 | A1 * | 9/2011 | Kameda | H01T 13/20 313/141 |
| 2013/0003251 | A1 * | 1/2013 | Durham | H01T 13/50 361/253 |

FOREIGN PATENT DOCUMENTS

| | | | | |
|---|---|---|---|---|
| JP | 2009-512172 | A | 3/2009 | |
| JP | 2013-186999 | A | 3/2013 | |
| JP | 2013186999 | * | 9/2013 | H01T 13/20 |
| WO | WO-2011/128589 | A | 10/2011 | |

* cited by examiner

SPARK PLUG

This application claims the benefit of Japanese Patent Application No. 2017-069843, filed Mar. 31, 2017, which is incorporated herein by reference in its entirety.

FIELD OF THE INVENTION

The present invention relates to a spark plug, and particularly to a spark plug that generates plasma.

BACKGROUND OF THE INVENTION

One example of a spark plug that generates plasma is disclosed in Japanese Patent Application Laid-Open No. 2009-512172. The spark plug disclosed in Japanese Patent Application Laid-Open No. 2009-512172 includes a center electrode, a metal shell that surrounds at least a part of the center electrode, and an insulator provided between the metal shell and the center electrode. The insulator includes a front end portion having an outer diameter larger than an inner diameter of the metal shell. The front end portion projects from a front end of the metal shell, and a front end of the center electrode projects from the front end portion of the insulator. When voltage is applied to the center electrode of the spark plug, gas in the vicinity of the front end of the center electrode undergoes dielectric breakdown and gaseous discharge occurs, so that plasma in which gas is ionized is generated.

Problems To Be Solved By The Invention

However, in the above-described conventional technique, insulation property between the center electrode and the metal shell is not sufficient. Thus, there is a problem that short circuit between the center electrode and the metal shell might occur without occurrence of gaseous discharge.

The present invention has been made in order to solve the above-described problem, and an object of the present invention is to provide a spark plug that allows gaseous discharge to occur easily.

SUMMARY OF THE INVENTION

Means for Solving the Problems

In order to attain the above object, a spark plug according to the present invention includes: a center electrode extending from a front side to a rear side along an axial line; an insulator having a through hole formed around at least a part of the center electrode; and a metal shell that holds the insulator from an outer peripheral side thereof and that is substantially tubular, the metal shell including a shelf portion that projects radially inward, the insulator including an engagement portion that is engaged with the shelf portion from the front side, and a front end portion that is present at the front side with respect to a front end of the metal shell, at least a part of the front end portion having an outer diameter larger than an inner diameter of the metal shell at the front side with respect to the shelf portion. The front end portion of the insulator has a diameter-enlarged portion at which a diameter of the through hole increases and which is spaced apart from an outer peripheral surface of the center electrode.

Effects of the Invention

In a spark plug according to a first aspect of the present invention, the insulator has, in a portion including the front end of the insulator, a diameter-enlarged portion at which a diameter of the through hole formed around at least a part of the center electrode is enlarged. Since the diameter-enlarged portion is spaced apart from an outer peripheral surface of the center electrode, gaseous discharge occurs so as to expand along a shape of the diameter-enlarged portion in a radial direction. Thus, since discharge toward the rear side (that is, the metal shell) is difficult to occur, short circuit between the center electrode and the metal shell can hardly occur. Therefore, gaseous discharge can easily occur.

In the spark plug according to a second aspect of the present invention, the insulator surrounds the outer circumference of the center electrode so as to reach at least the front end of the center electrode. Thus, short circuit between the center electrode and the metal shell is more difficult to occur. Therefore, in addition to the effect of the first aspect, gaseous discharge can more easily occur.

In the spark plug according to a third aspect of the present invention, the insulator includes a first insulator having the engagement portion and a second insulator having the front end portion. Since the second insulator is joined, directly or via another member, to the first insulator at the front side with respect to the engagement portion, in addition to the effect of the first or second aspect, the front end portion can be easily provided to the insulator.

In the spark plug according to a fourth aspect of the present invention, a part of the second insulator is present inside the metal shell. Thus, a part of the second insulator can be prevented from being exposed to combustion gas. Since overheating of the second insulator can be suppressed as compared with the case where the entirety of the second insulator is exposed to combustion gas, in addition to the effect of the third aspect, ignition of air-fuel mixture, due to abnormal overheating of the second insulator, can be further suppressed.

In the spark plug according to a fifth aspect of the present invention, the metal shell has a thread portion on an outer peripheral surface of the metal shell, the thread portion being screwed into a thread hole of an internal combustion engine. Since at least a part of the second insulator is present inside a portion where the thread portion of the metal shell is present, heat can be transferred from the second insulator via the thread portion to the internal combustion engine. Thus, since overheating of the second insulator can be suppressed, in addition to the effect of the third or fourth aspect, ignition of air-fuel mixture, due to abnormal overheating of the second insulator, can be further suppressed.

DETAILED DESCRIPTION OF THE INVENTION

Figure 1:
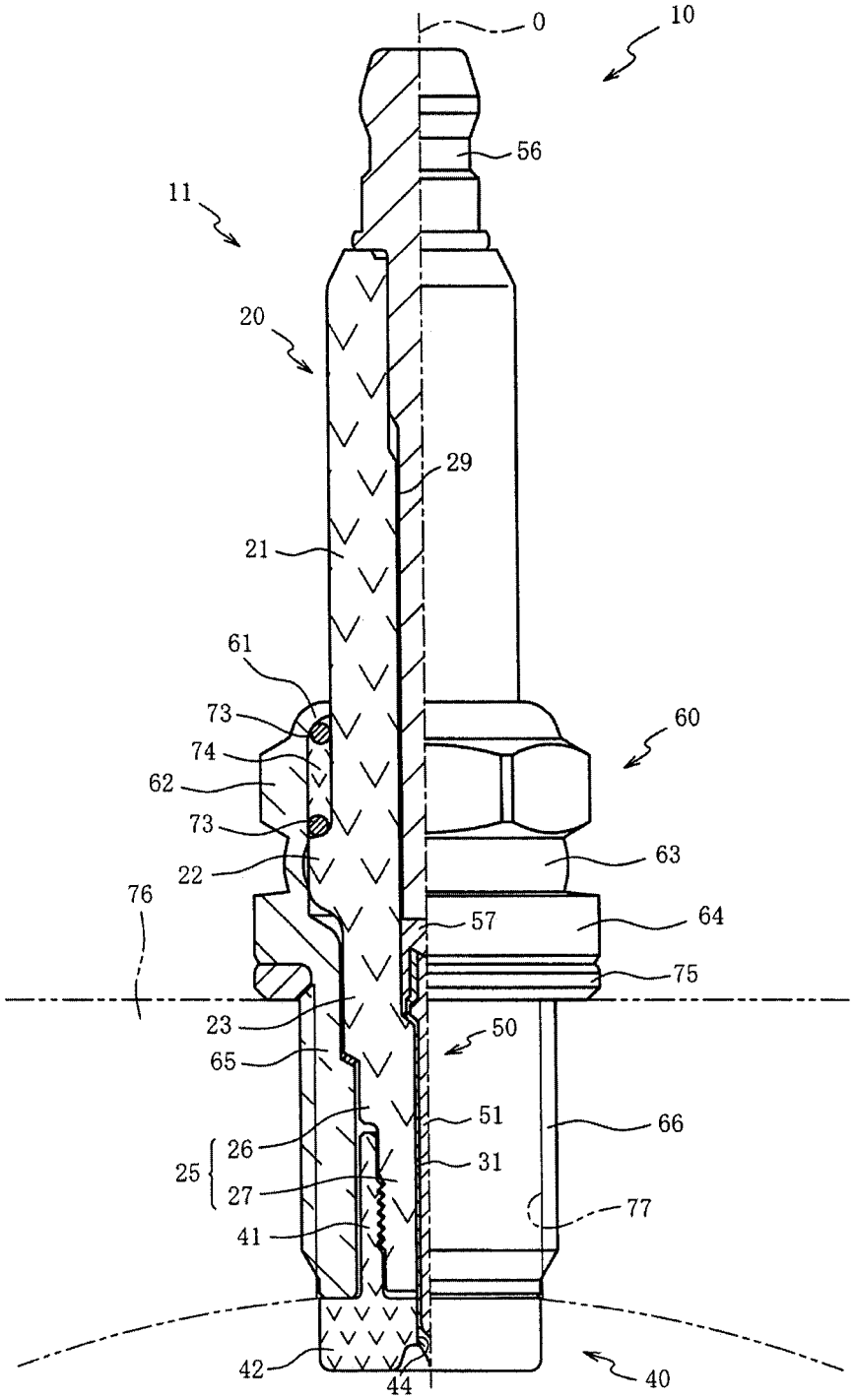
FIG. 1 is a one-side-sectional view of a spark plug according to a first embodiment of the present invention.
Figure 2:
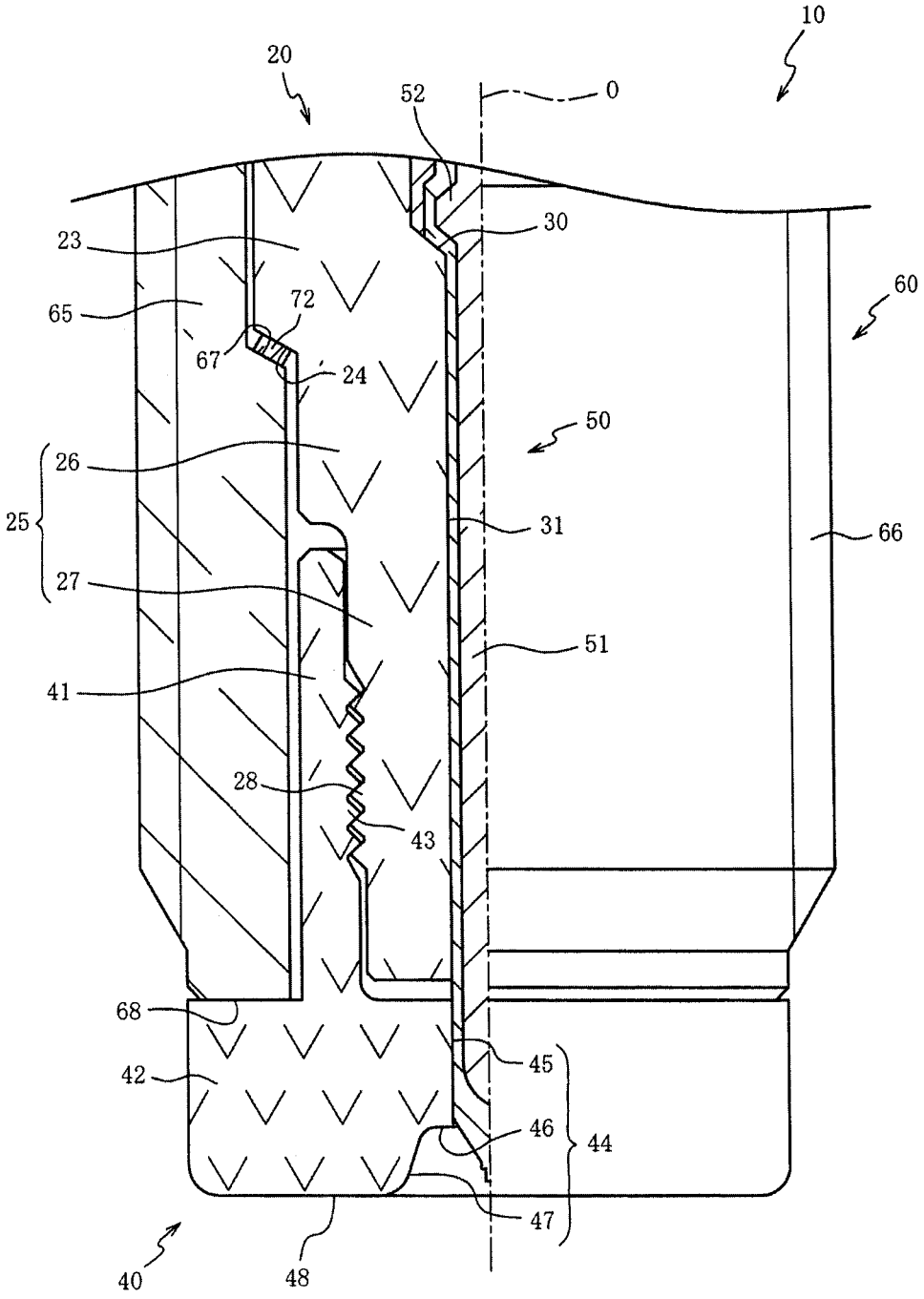
FIG. 2 is a partially enlarged one-side-sectional view of the spark plug.

Hereinafter, preferred embodiments of the present invention will be described with reference to the accompanying drawings. FIG. 1 is a one-side-sectional view of a spark plug 10 according to the first embodiment of the present invention, with an axial line O thereof as a boundary, FIG. 2 is a partially enlarged one-side-sectional view of the spark plug 10. In FIGS. 1 and 2, the lower side on the drawing sheet is referred to as a front side of the spark plug 10, and the upper side on the drawing sheet is referred to as a rear side of the spark plug 10 (the same applies to FIG. 3). In FIG. 2, the rear side of the spark plug 10 in an axial line O direction is not shown.

As shown in FIG. 1, the spark plug 10 includes an insulator 11, a center electrode 50, and a metal shell 60. The insulator 11 is a member formed from alumina or the like which is excellent in mechanical property and insulation property at a high temperature. The insulator 11 includes a first insulator 20 and a second insulator 40.

In the first insulator 20, a trunk portion 21, a projection portion 22, a large-diameter portion 23, and a small-diameter portion 25 are connected in this order from the rear side to the front side along the axial line O, and a first through hole 29, formed along the axial line O, penetrates through the center of the first insulator 20. The trunk portion 21 is located to the rear side of the first insulator 20. The first insulator 20 has the projection portion 22 projecting in a flange shape radially outward from a boundary between the trunk portion 21 and the large-diameter portion 23. The projection portion 22 is formed around the entire circumference of the boundary between the trunk portion 21 and the large-diameter portion 23.

The small-diameter portion 25 provided to the front side of the large-diameter portion 23 includes a first small-diameter portion 26 and a second small-diameter portion 27. The second small-diameter portion 27 is disposed at the front side of the first small-diameter portion 26. An outer diameter of the first small-diameter portion 26 is larger than an outer diameter of the second small-diameter portion 27 and is smaller than an outer diameter of the large-diameter portion 23. Due to a difference between the outer diameter of the large-diameter portion 23 and the outer diameter of the first small-diameter portion 26, an engagement portion 24 (see FIG. 2) facing toward the front side is formed on the outer circumference of the large-diameter portion 23. The engagement portion 24 has a diameter that decreases toward the front side in the axial line O direction. An external thread portion 28 (see FIG. 2) is formed on the outer circumference of the second small-diameter portion 27.

An inner diameter of the first through hole 29 is made smaller by a step portion 30 (see FIG. 2) formed in the large-diameter portion 23, and an axial hole 31 is formed from the large-diameter portion 23 to the small-diameter portion 25. The step portion 30 and the axial hole 31 are a part of the first through hole 29. The step portion 30 has a diameter that decreases toward the front side in the axial line O direction.

The second insulator 40 is a member that surrounds the periphery of the second small-diameter portion 27 of the first insulator 20. The second insulator 40 includes a cylindrical portion 41, and a front end portion 42 that is present at the front side with respect to the front end of the metal shell 60. An internal thread portion 43 (see FIG. 2) is formed on the inner circumference of the cylindrical portion 41. The front end portion 42 is formed in a substantially disc shape.

As shown in FIG. 2, the internal thread portion 43 is engaged with the external thread portion 28 formed on the outer circumference of the second small-diameter portion 27 of the first insulator 20, and thus directly joins the second insulator 40 to the first insulator 20. An outer diameter of the cylindrical portion 41 is substantially equal to the outer diameter of the first small-diameter portion 26 of the first insulator 20. A wall thickness of the cylindrical portion 41 in a radial direction is substantially equal to a difference between the outer diameter of the first small-diameter portion 26 and the outer diameter of the second small-diameter portion 27. A length of the cylindrical portion 41 in the axial line O direction is substantially equal to a length of the second small-diameter portion 27 in the axial line O direction.

In the front end portion 42, a second through hole 44 that penetrates the center along the axial line O is formed. In the second through hole 44, a hole portion 45, an enlargement portion 46, and a diameter-enlarged portion 47 are connected to each other from the rear side to a front end 48 side. An inner diameter of the hole portion 45 is equal to an inner diameter of the axial hole 31 formed in the first insulator 20. In a state where the internal thread portion 43 is engaged with the external thread portion 28 so that the second insulator 40 is joined to the first insulator 20, the hole portion 45 becomes contiguous to the axial hole 31. The enlargement portion 46 is an annular portion that extends in an axial orthogonal direction perpendicular to the axial line O. The diameter-enlarged portion 47 is a portion that has an inner diameter larger than the inner diameter of the hole portion 45 and that is formed in a portion including the front end 48 of the insulator 11.

The portion including the front end 48 of the insulator 11 is a portion which is located at the front side in the axial line O direction of the insulator 11 and in which the center electrode 50 is disposed. The diameter-enlarged portion 47 is formed so as to be connected to the front end 48 of the insulator 11. In the present embodiment, the diameter-enlarged portion 47 is formed on the second insulator 40 at which the front side of the center electrode 50 is disposed, and the inner diameter of the diameter-enlarged portion 47 gradually increases toward the front end 48 side of the second insulator 40 up to the front end 48.

The center electrode 50 is a conductive member that includes an axial portion 51 formed in a rod shape and an engagement portion 52 provided at the rear end of the axial portion 51. The engagement portion 52 is a portion that extends, as compared with the axial portion 51, in the axial orthogonal direction orthogonal to the axial line O, and is engaged with the step portion 30 of the first insulator 20.

In the axial portion 51, a core material having a more excellent thermal conductivity than an electrode base material is embedded inside the electrode base material formed in a bottomed tubular shape. The core material is formed from copper or an alloy containing copper as a main component, and the electrode base material is formed from a nickel-based alloy, nickel, or the like. The axial portion 51 is disposed in the axial hole 31 of the first insulator 20 and the second through hole 44 of the second insulator 40. The axial portion 51 has a front end that is formed in a needle shape. The outer peripheral surface of the axial portion 51 is spaced apart from the diameter-enlarged portion 47. In the present embodiment, the second insulator 40 surrounds the front end of the axial portion 51 of the center electrode 50. In addition, the maximum outer diameter of a portion disposed in the diameter-enlarged portion 47, of the axial portion 51, is smaller than the outer diameter of a portion disposed at the rear side with respect to the diameter-enlarged portion 47, of the axial portion 51.

A description will be given returning to FIG. 1. A metal terminal 56 is a rod-shaped member to which a high-voltage cable (not shown) is connected, and is formed from a metal material (e.g., low-carbon steel, etc.) having conductivity. The front side of the metal terminal 56 is disposed in the first through hole 29 of the first insulator 20. A sealing material 57 having conductivity is disposed between the metal terminal 56 and the engagement portion 52 (see FIG. 2) of the center electrode 50. For the sealing material 57, for example, a composition containing glass particles such as a $B_2O_3$—$SiO_2$-based material and metal particles such as Cu or Fe is used. Via the sealing material 57, the center electrode 50 and the metal terminal 56 are electrically connected to each other in the first through hole 29.

The metal shell 60 is a substantially cylindrical member that is fixed to an internal combustion engine 76, and is formed from a metal material (e.g., low-carbon steel, stainless steel, etc.) having conductivity. In the metal shell 60, a crimping portion 61, a tool engagement portion 62, a curved portion 63, a seat portion 64, and a trunk portion 65 are connected in this order from the rear side to the front side along the axial line O. A thread portion 66 is formed on the outer peripheral surface of the trunk portion 65.

The crimping portion 61 and the curved portion 63 are portions for crimping the first insulator 20. The tool engagement portion 62 is a portion for engaging a tool such as wrench when the thread portion 66 is coupled with a thread hole 77 of the internal combustion engine 76. The seat portion 64 is a portion that is located to the rear side of the trunk portion 65 and that projects radially outward in an annular shape. A gasket 75 having an annular shape is disposed between the seat portion 64 and the trunk portion 65. When the metal shell 60 is mounted to the internal combustion engine 76, the gasket 75 seals a gap between the thread portion 66 and the thread hole 77.

As shown in FIG. 2, a shelf portion 67 that projects radially inward is provided on the inner circumference of the trunk portion 65. The shelf portion 67 has a diameter that decreases toward the front side in the axial line O direction. A packing 72 is disposed in the shelf portion 67. The packing 72 is an annular plate material formed from a metal material such as a mild metal plate.

A front end 68 of the trunk portion 65 (the metal shell 60) is in contact with the front end portion 42 of the second insulator 40. An outer diameter of the front end portion 42 of the second insulator 40 is larger than the inner diameter (the inner diameter of the front end 68) of the trunk portion 65 on a front end 68 side (the lower side of FIG. 2) with respect to the shelf portion 67. The cylindrical portion 41 of the second insulator 40 is present inside the trunk portion 65 on the outer circumference of which the thread portion 66 is formed.

As shown in FIG. 1, a pair of ring members 73, and powder 74, such as talc, that is interposed between the pair of the ring members 73, are disposed between the inner circumference of the tool engagement portion 62 of the metal shell 60 and the outer circumference of the trunk portion 21 of the first insulator 20. When the crimping portion 61 of the metal shell 60 is deformed and is in close contact with the ring member 73, the engagement portion 24 of the first insulator 20 is pressed toward the shelf portion 67 of the metal shell 60, via the ring member 73, the powder 74, and the projection portion 22. Thus, the metal shell 60 is mounted to the first insulator 20 via the packing 72, the ring member 73, and the powder 74. The packing 72 airtightly closes a gap between the shelf portion 67 and the engagement portion 24.

The spark plug 10 is manufactured by, for example, a method described below. First, the axial portion 51 of the center electrode 50 is inserted into the axial hole 31 of the first insulator 20, and the engagement portion 52 is caused to be engaged with the step portion 30. Next, the first through hole 29 is filled with a raw material powder of the sealing material 57, the metal terminal 56 is pressed into the first through hole 29 while being heated, and the raw material powder of the sealing material 57 is compressed in an axial direction. The raw material powder is compressed and sintered, and electrical continuity between the metal terminal 56 and the center electrode 50 is ensured via the sealing material 57. Then, while the axial portion 51 of the center electrode 50 is inserted into the second through hole 44 of the second insulator 40, the internal thread portion 43 of the second insulator 40 is coupled with the external thread portion 28 of the first insulator 20, so that the second insulator 40 is joined to the first insulator 20. Lastly, the metal shell 60 is assembled to the outer circumferences of the first insulator 20 and the second insulator 40, so that the spark plug 10 is obtained.

In the spark plug 10, when the thread portion 66 of the metal shell 60 is mounted into the thread hole 77 of the internal combustion engine 76 (see FIG. 1), the front end portion 42 of the second insulator 40 is exposed to a combustion chamber of the internal combustion engine 76. When voltage is applied between the metal terminal 56 and the metal shell 60, gas partially undergoes dielectric breakdown in the vicinity of the front end of the center electrode 50, so that gaseous discharge (corona discharge) is formed. By the discharge, the spark plug 10 ionizes the gas (air-fuel mixture) to bring the gas into a plasma state, and generates flame kernel in the air-fuel mixture.

The spark plug 10 has, in the portion including the front end 48 of the insulator 11, the diameter-enlarged portion 47 at which the diameter of the second through hole 44 surrounding at least a part of the center electrode 50 is enlarged. Since the diameter-enlarged portion 47 is spaced apart from the outer peripheral surface of the center electrode 5, gaseous discharge occurs so as to expand in the radial direction in accordance with the shape of the diameter-enlarged portion 47. Thus, since discharge toward the metal shell 60 is difficult to occur, short circuit between the center electrode 50 and the metal shell 60 can hardly occur and gaseous discharge can easily occur. Therefore, the amount of plasma generated by the spark plug 10 can be ensured.

The second through hole 44 has the enlargement portion 46 between the hole portion 45 and the diameter-enlarged portion 47. Since the enlargement portion 46 annularly extends in the axial orthogonal direction perpendicular to the axial line O, a spatial distance between the outer peripheral surface of the center electrode 50 and the diameter-enlarged portion 47 can be increased as compared with the case where the enlargement portion 46 is absent. As a result, the range of the diameter-enlarged portion 47 in which gaseous discharge is present can be extended in the radial direction, and thus ignitability can be improved.

Since the diameter-enlarged portion 47 has an inner diameter that gradually increases toward the front end 48 side of the second insulator 40 up to the front end 48, gaseous discharge can be radially expanded to the front end 48 side. Since the range in which gaseous discharge is present can be extended as compared with the case where the inner diameter of the diameter-enlarged portion 47 is the same in the axial line O direction, ignitability can be improved.

Since the diameter-enlarged portion 47 is formed in the portion including the front end 48 of the insulator 11 (in the present embodiment, a part of the front end portion 42 of the second insulator 40), short circuit between the center electrode 50 and the metal shell 60 can be suppressed while heat dissipation performance of the center electrode 50 by the insulator 11 is ensured. This is because in a case where the diameter-enlarged portion 47 is formed in the axial hole 31 and the hole portion 45 from the step portion 30 of the insulator 11 to the front end 48 side, a gap (diameter-enlarged portion 47) between the center electrode 50, and the axial hole 31 and the hole portion 45 causes reduction in heat dissipation performance of the center electrode 50 by the insulator 11.

Since the second insulator 40 (insulator 11) surrounds the outer circumference of the center electrode 50 so as to reach at least the front end of the center electrode 50, short circuit between the center electrode 50 and the metal shell 60 is more difficult to occur as compared with the case where the front end of the center electrode 50 projects beyond the front end 48 of the second insulator 40. Thus, gaseous discharge can more easily occur.

The maximum outer diameter of a part, of the axial portion 51 of the center electrode 50, that is disposed in the diameter-enlarged portion 47 is smaller than the outer diameter of a part of the axial portion 51 that is disposed at the rear side with respect to the diameter-enlarged portion 47. Therefore, a spatial distance between the center electrode 50 and the diameter-enlarged portion 47 can be increased. Thus, gaseous discharge in the diameter-enlarged portion 47 can easily occur. Thus, short circuit between the center electrode 50 and the metal shell 60 is more difficult to occur. Therefore, gaseous discharge can more easily occur.

Since the outer diameter of the front end portion 42 of the second insulator 40 is larger than an inner diameter of the trunk portion 65 at the front side (the lower side of FIG. 2) with respect to the shelf portion 67, a creepage distance of the front end portion 42 from the outer peripheral surface of the trunk portion 65 to the center electrode 50 can be increased as compared with the case where the outer diameter of the front end portion 42 is smaller than the inner diameter of the trunk portion 65 at the front side with respect to the shelf portion 67. Thus, since surface discharge between the center electrode 50 and the metal shell 60 can hardly occur, gaseous discharge can easily occur.

The insulator 11 includes: the first insulator 20 having the engagement portion 24 supported by the shelf portion 67; and the second insulator 40 having the front end portion 42. In a case where the insulator 11 is not divided into two members of the first insulator 20 and the second insulator 40, it is difficult to provide, at the front end 68 of the metal shell 60, the front end portion 42 having an outer diameter larger than a minimum inner diameter of the shelf portion 67. However, since the second insulator 40 is joined to the first insulator 20 at the front side with respect to the engagement portion 24, the front end portion 42 having an outer diameter larger than an inner diameter of the shelf portion 67 can be easily provided without being restricted by the inner diameter of the shelf portion 67.

Since the internal thread portion 43 of the second insulator 40 is coupled with the external thread portion 28 of the first insulator 20 so that the second insulator 40 is joined to the first insulator 20, joining reliability can be improved as compared with the case where the second insulator 40 is joined to the first insulator 20 by only an inorganic adhesive without using threads.

When the internal thread portion 43 and the external thread portion 28 are provided, a creepage distance of each of the outer circumference of the second small-diameter portion 27 and the inner circumference of the cylindrical portion 41 can be increased as compared with the case where no thread is provided. Thus, short circuit, between the metal shell 60 and the center electrode 50, that has a path between the second small-diameter portion 27 and the cylindrical portion 41, can be suppressed. Since the area of contact between the first insulator 20 and the second insulator 40 can be increased by the internal thread portion 43 and the external thread portion 28, heat transfer between the first insulator 20 and the second insulator 40 can be improved by the internal thread portion 43 and the external thread portion 28.

Since the internal thread portion 43 and the external thread portion 28 are formed radially inward of the thread portion 66 of the metal shell 60, heat transferred from the first insulator 20 to the second insulator 40 via the internal thread portion 43 and the external thread portion 28 can be easily dissipated from the thread portion 66 of the metal shell 60 via the thread hole 77 to the internal combustion engine 76.

The front end 68 of the trunk portion 65 (the metal shell 60) is in contact with the front end portion 42 of the second insulator 40. Therefore, in a state where the internal thread portion 43 is coupled with the external thread portion 28, axial tension for tightening the external thread portion 28 and the internal thread portion 43 can be ensured. Thus, since friction between a flank of the external thread portion 28 and a flank of the internal thread portion 43 can be increased, the internal thread portion 43 can be made difficult to loosen.

The shelf portion 67 of the metal shell 60 projects, around the entire circumference of the shelf portion 67, inward in the axial orthogonal direction with respect to the engagement portion 24, and supports the engagement portion 24 of the first insulator 20 from the front side. Thus, when the large-diameter portion 23 provided to the first insulator 20 is supported by the shelf portion 67 of the metal shell 60, the insulator 11 is held on the inner circumference of the metal shell 60. Since the large-diameter portion 23 is provided to the first insulator 20 that covers the axial portion 51, a thickness of the large-diameter portion 23 in the axial orthogonal direction can be increased as compared to the case where the large-diameter portion 23 is provided to the second insulator 40 that covers the outer circumference of the first insulator 20. Thus, mechanical strength of the large-diameter portion 23 can be ensured.

In the second insulator 40, the cylindrical portion 41 is present inside the metal shell 60. Therefore, the cylindrical portion 41 can be prevented from being exposed to combustion gas in a combustion chamber. Since overheating of the second insulator 40 can be suppressed as compared with the case where the entirety of the second insulator 40 is exposed to combustion gas, ignition of air-fuel mixture due to abnormal overheating of the second insulator 40 can be suppressed.

The cylindrical portion 41 of the second insulator 40 is present inside the trunk portion 65 on the outer circumference, of the metal shell 60, of which the thread portion 66 is formed. Thus, heat of the second insulator 40 can be transferred, via the cylindrical portion 41, the trunk portion 65, and the thread portion 66, to the internal combustion engine 76. Thus, since overheating of the second insulator 40 can be suppressed, ignition of air-fuel mixture due to abnormal overheating of the second insulator 40 can be further suppressed.

Of the trunk portion 65, a portion on the front end 68 side with respect to the shelf portion 67 has an equal inner diameter up to the front end 68. Therefore, a wall thickness of the trunk portion 65 on the front end 68 side with respect to the shelf portion 67 can be ensured. Thus, heat capacity of the trunk portion 65 that is present radially outward of the cylindrical portion 41 of the second insulator 40 can be ensured. Since the outer diameter of the cylindrical portion 41 is substantially equal to the outer diameter of the first small-diameter portion 26 of the first insulator 20, and the wall thickness of the cylindrical portion 41 in the radial direction is substantially equal to a difference between the outer diameter of the first small-diameter portion 26 and the outer diameter of the second small-diameter portion 27, a gap between the trunk portion 65, and the first small-diameter portion 26 and the cylindrical portion 41 can be decreased. Thus, heat can be easily transferred from the first small-diameter portion 26 and the cylindrical portion 41 to the trunk portion 65. Thus, since overheating of the second insulator 40 can be suppressed, ignition of air-fuel mixture due to abnormal overheating of the second insulator 40 can be further suppressed.

Since the front end 68 of the trunk portion 65 (metal shell 60) is in contact with the front end portion 42 of the second insulator 40, heat transfer from the front end portion 42 to the trunk portion 65 is not hampered. Thus, since overheating of the second insulator 40 can be suppressed, ignition of air-fuel mixture due to abnormal overheating of the second insulator 40 can be further suppressed.

Figure 3:
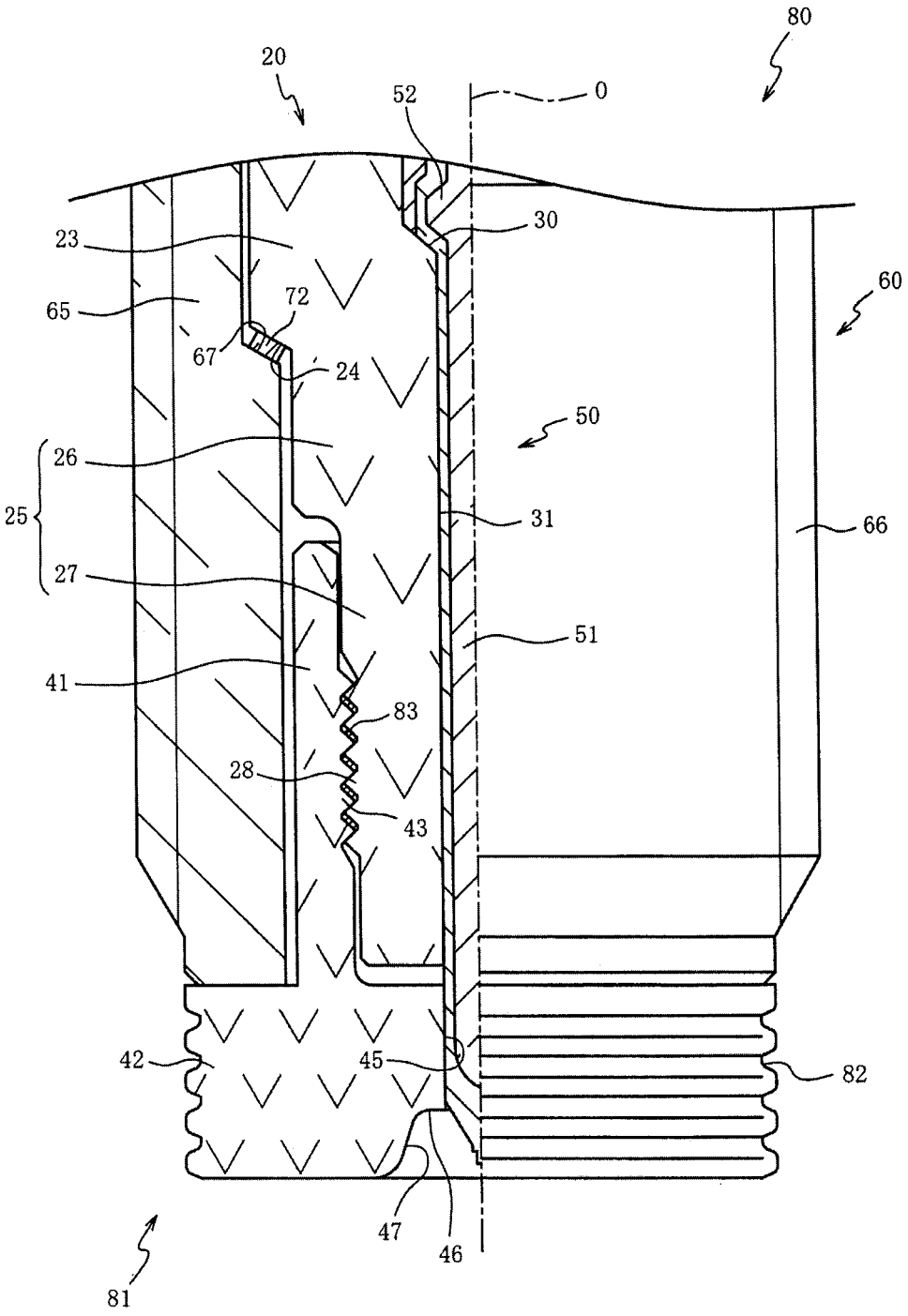
FIG. 3 is a one-side-sectional view of a spark plug according to a second embodiment.

With reference to FIG. 3, a second embodiment will be described. In the first embodiment, the case where the second insulator 40 is directly joined to the first insulator 20 has been described. On the other hand, in the second embodiment, the case where a second insulator 81 is joined to the first insulator 20 via a filler 83 (another member) will be described. The same components as described in the first embodiment will be denoted by the same reference numerals, and the description thereof is not given. FIG. 3 is a one-side-sectional view of a spark plug 80 according to the second embodiment with an axial line O thereof as a boundary. In FIG. 3, the rear side of spark plug 80 is not shown.

As shown in FIG. 3, in the spark plug 80, the second insulator 81 is joined to the first insulator 20. In the second insulator 81, a plurality of corrugations 82 are formed on the outer peripheral surface of the front end portion 42. In the spark plug 80, another member (filler 83) different from the first insulator 20 or the second insulator 81 is disposed at a gap between the internal thread portion 43 of the second insulator 81 and the external thread portion 28 of the first insulator 20. The filler 83 has heat resistance and insulation property, and is in close contact with at least a part of the internal thread portion 43 and the external thread portion 28. For the filler 83, for example, the inorganic adhesive (that is, cement), a composition containing glass particles of a $B_2O_3$—$SiO_2$-based material, or the like is used. The internal thread portion 43 and the external thread portion 28 are adhered to each other with the filler 83.

Since the filler 83 having insulation property is disposed at a gap between the internal thread portion 43 and the external thread portion 28, and is in close contact with at least a part of the internal thread portion 43 and the external thread portion 28, an effect of suppressing short circuit having a path between the second small-diameter portion 27 and the cylindrical portion 41 can be improved. The filler 83 is in close contact with the internal thread portion 43 and the external thread portion 28, and therefore, depending on a coefficient of thermal conductivity of the filler 83, thermal conductivity between the internal thread portion 43 and the external thread portion 28 can be improved, and heat dissipation from the second insulator 40 to the first insulator 20 can be improved.

Since the internal thread portion 43 and the external thread portion 28 are adhered to each other with the filler 83, loosening of the internal thread portion 43 with respect to the external thread portion 28 can be prevented. Thus, joining reliability of the second insulator 40 with respect to the first insulator 20 can be ensured.

Since the second insulator 81 has the plurality of corrugations 82 on the outer peripheral surface of the front end portion 42, the creepage distance of the outer peripheral surface of the front end portion 42 can be increased as compared with the case where the corrugations are absent. Thus, since the surface discharge between the center electrode 50 and the metal shell 60 can hardly occur, gaseous discharge can more easily occur.

As described above, although the present invention has been described based on the embodiments, the present invention is not limited to the above embodiments at all. It can be easily understood that various modifications can be devised without departing from the gist of the present invention.

In the above embodiments, the case where the insulator 11 is divided into two members of the first insulator 20 and the second insulator 40, or the first insulator 20 and the second insulator 81, has been described. However, the present invention is not necessarily limited thereto. As a matter of course, the insulator 11 in which the first insulator 20 and the second insulator 40, or the first insulator 20 and the second insulator 81 are integrated with each other can be used. In this case, members obtained by dividing the metal shell 60 into two parts are prepared, the members are mounted to the outer circumference of the insulator 11 from both sides in the axial orthogonal direction of the insulator 11, and then the members are welded to each other. Thus, the metal shell 60 can be mounted to the outer circumference of the insulator 11. Also in a case where the insulator 11 is formed from one member, the diameter-enlarged portion 47 is formed at a part where the center electrode 50 (specifically, the front end of the axial portion 51) is disposed in the insulator 11, so as to be connected to the front end 48 of the insulator 11.

In the above embodiments, the case where the second insulator 40, 81 is connected to the first insulator 20 via the external thread portion 28 and the internal thread portion 43 has been described. However, the present invention is not necessarily limited thereto. As a matter of course, the second insulator 40, 81 can be joined to the first insulator 20 using the inorganic adhesive without providing the external thread portion 28 and the internal thread portion 43.

Although description is omitted in the above embodiments, the external thread portion 28 and the internal thread portion 43 are continuously provided or intermittently provided. Although description is omitted in the above embodiments, as a matter of course, the filler 83 described in the second embodiment can be filled between the external thread portion 28 and the internal thread portion 43 that have been described in the first embodiment.

In the above embodiments, the case where the front end portion 42 of the second insulator 40, 81 is in contact with the front end 68 of the metal shell 60 has been described. However, the present invention is not necessarily limited thereto. In a case where the second insulator 40, 81 is screwed into the first insulator 20 using a thread, instead of the metal shell 60, the front end portion 42 of the second insulator 40, 81 can be in contact with the front end of the first insulator 20 in order to ensure tightening axial tension. In a case where the external thread portion 28 and the internal thread portion 43 are omitted and the second insulator 40, 81 is joined to the first insulator 20 using the inorganic adhesive, tightening axial tension is not required, so that the second insulator 40, 81 is not required to be in contact with the first insulator 20 or the metal shell 60.

Although, in the above embodiments, the metal shell 60 is crimped into the first insulator 20 via the ring member 73 and the powder 74, the present invention is not necessarily limited thereto. As a matter of course, the metal shell 60 can be crimped without using the ring member 73 and the powder 74.

DESCRIPTION OF REFERENCE NUMERALS

10, 80: spark plug
11: insulator
20: first insulator
24: engagement portion
29: first through hole (through hole)
40, 81: second insulator
42: front end portion
44: second through hole (through hole)
47: diameter-enlarged portion
48: front end
50: center electrode
60: metal shell
66: thread portion
67: shelf portion
76: internal combustion engine
77: thread hole
83: filler (another member)
O: axial line

The invention claimed is:

1. A spark plug comprising:

a center electrode extending from a front side to a rear side along an axial line;

an insulator having a through hole formed around at least a part of the center electrode; and a metal shell that holds the insulator from an outer peripheral side thereof and that is substantially tubular, wherein the metal shell includes a shelf portion that projects radially inward, the insulator includes a first insulator containing an engagement portion that is engaged with the shelf portion and faces the front side of the center electrode, the insulator further includes a second insulator containing a front end portion that is present at the front side with respect to a front end of the metal shell, the second insulator being joined to the first insulator at a portion that is further toward the front side than the engagement portion, at least a part of the front end portion has an outer diameter larger than an inner diameter of the metal shell at the front side with respect to the shelf portion, and the front end portion of the second insulator has a diameter-enlarged portion at which a diameter of the through hole increases and which is spaced apart from an outer peripheral surface of the center electrode.

2. The spark plug according to claim 1, wherein the second insulator surrounds an outer circumference of the center electrode so as to reach at least a front end of the center electrode.

3. The spark plug according to claim 1, wherein a part of the second insulator is present inside the metal shell.

4. The spark plug according to claim 1, wherein the metal shell has a thread portion on an outer peripheral surface thereof, said thread portion being screwed into a thread hole of an internal combustion engine, and at least a part of the second insulator is present inside a portion of the metal shell where the thread portion is present.

5. The spark plug according to claim 1, wherein the second insulator further comprises a forward-most end, and the diameter-enlarged portion is formed so as to be connected to the forward-most end of the second insulator.

* * * * *